US006023805A

United States Patent [19]

Lin

[11] Patent Number: 6,023,805

[45] Date of Patent: Feb. 15, 2000

[54] TOOL COMBINATION HAVING EASILY CHANGEABLE TOOL MEMBERS

[76] Inventor: Hsing Tai Lin, P.O. Box 63-99, Taichung, Taiwan, 406

[21] Appl. No.: 09/188,334

[22] Filed: Nov. 9, 1998

[51] Int. Cl.[7] ..... B25B 7/22

[52] U.S. Cl. ..... 7/128; 7/118; 7/125; 81/318

[58] Field of Search ..... 7/125, 127, 128, 7/129, 132, 133, 134, 118, 130, 131, 138; 81/318, 319, 324

[56] References Cited

U.S. PATENT DOCUMENTS 4,744,272 5/1988 Leatherman ..... 81/427.5

5,245,721 9/1993 Lowe et al. ..... 7/129

*Primary Examiner*—Timothy V. Eley
*Assistant Examiner*—Willie Berry, Jr.

[57] ABSTRACT

A tool device includes a pair of handles each having a chamber formed by a pair of panels and each having a pin secured in the middle portion. A tool member includes two ends each having a tool portion and includes a middle portion engaged with a fastener which is engaged with the ends of the handles for pivotally coupling the handles and the tool member together. The distance between the fastener and the pins is shorter than the tool portions such that the pins may be forced to engage with one of the tool portions for allowing the other tool portion to be used.

8 Claims, 6 Drawing Sheets

TOOL COMBINATION HAVING EASILY CHANGEABLE TOOL MEMBERS

BACKGROUND OF THE INVENTION

1. Field of the Invention

The present invention relates to a tool, and more particularly to a tool combination having a number of tool members that may be easily changed and driven by a pair of handles.

2. Description of the Prior Art

Typical pliers comprise a pair of jaws actuateable by a pair of handles which are solidly secured to the jaws and may not be disengaged from the jaws, such that the jaws may not be replaced with another tool members and such that the handles may not be used for driving different tool members.

The present invention has arisen to mitigate and/or obviate the afore-described disadvantages of the conventional tools.

SUMMARY OF THE INVENTION

The primary objective of the present invention is to provide a tool combination having a number of tool members that may be easily changed and driven by a pair of handles.

In accordance with one aspect of the invention, there is provided a tool combination comprising a pair of handles each including a chamber defined by a pair of panels and each including a middle portion having a pin secured therein and each including a first end and a second end, a tool member including a middle portion and including a first end having a first tool portion and a second end having a second tool portion provided therein, and a fastener engaged with the first ends of the handles and the middle portion of the tool member together for allowing the handles and the tool member to be rotated about the fastener, a distance between the fastener and the pins being shorter than the first tool portion and the second tool portion for allowing the pins to engage with the first tool portion when the second tool portion is to be used and for allowing the pins to engage with the second tool portion when the first tool portion is to be used. The other tool members may also be selected and replaceably and pivotally coupled to the handles at the fastener.

The tool member includes a pair of beams having a middle portion pivotally secured to the fastener, the beams include a first end having the first tool portion and a second end having the second tool portion.

The first tool portion and the second tool portion may be wrench tools. The second end of a first of the handles includes an engaging hole for receiving a tool bit. The first handle includes a pivotal cover for enclosing the chamber of the first handle and for receiving tool bits in the chamber of the first handle. A second of the handles includes a plurality of tools pivotally secured to the second handle at a shaft for allowing the tools to be rotated inward and outward of the chamber of the second handle.

A first of the pins includes a head. A locking device is further provided for locking the handles together and includes a latch pivotally secured to a second of the pins and having at least one latch opening for receiving the head of the first pin and for locking the handles together.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
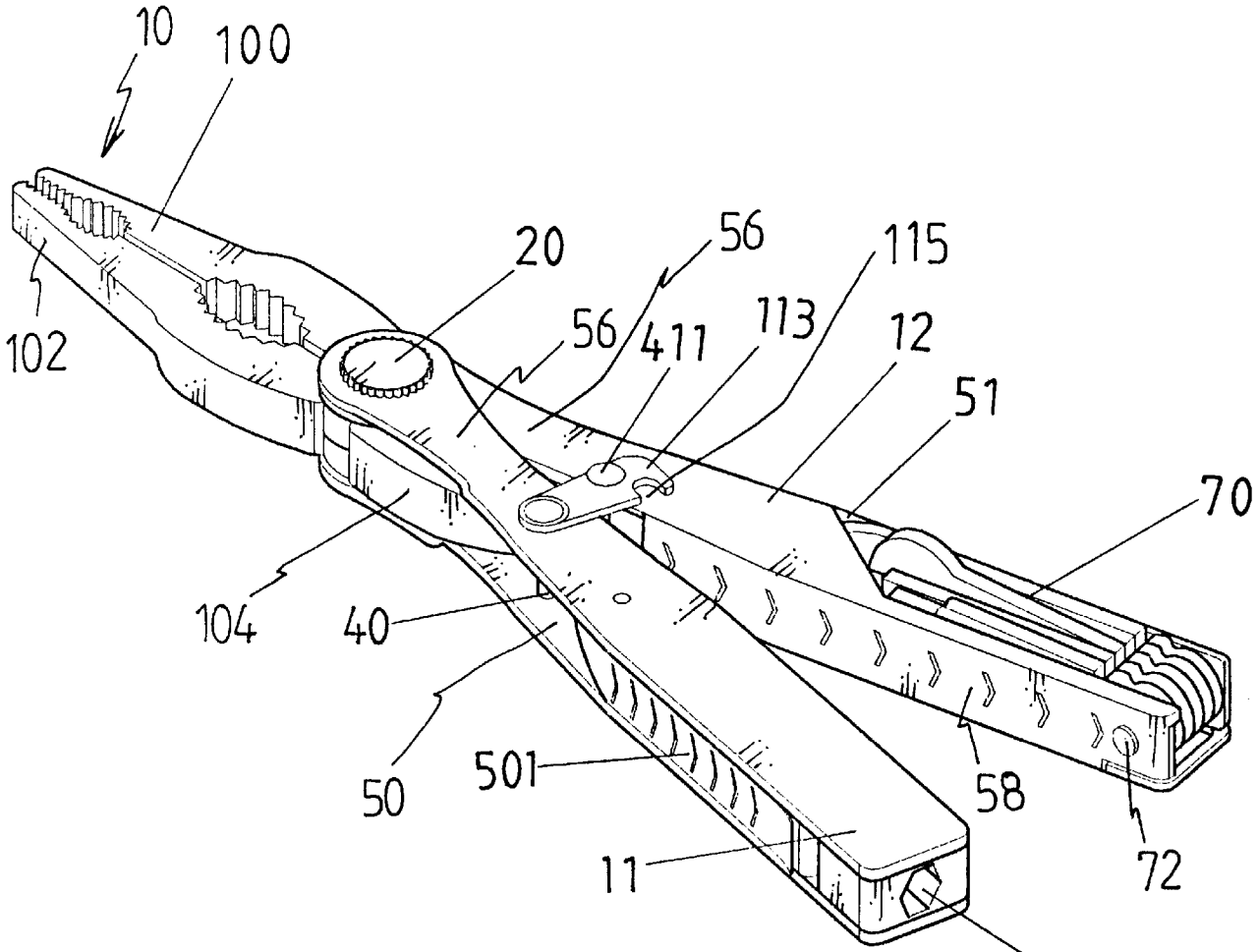
FIG. 1 is a perspective view of a tool combination in accordance with the present invention.
Figure 2:
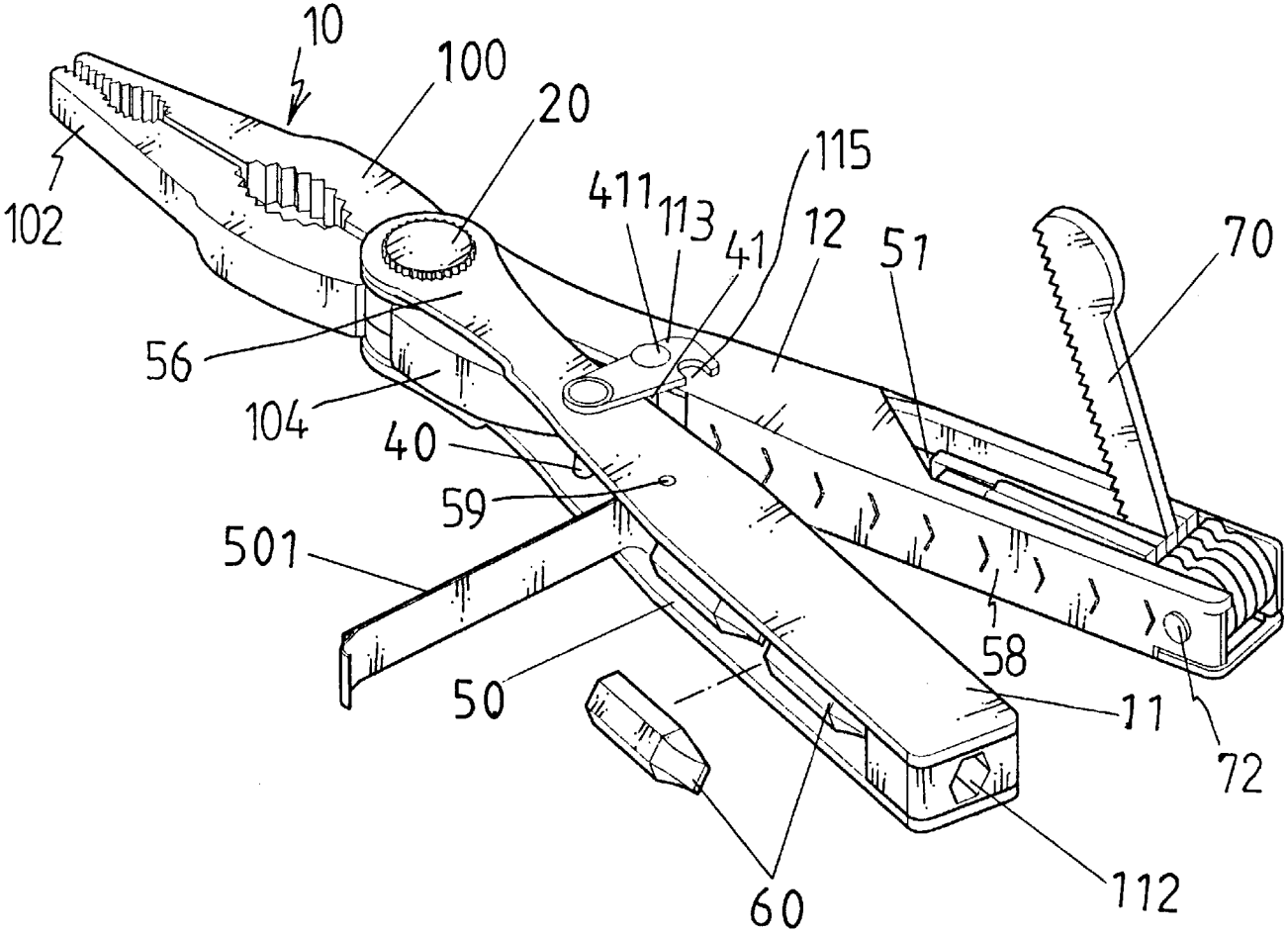
FIGS. 2 and 3 are partial exploded views of the tool combination.
Figure 3:
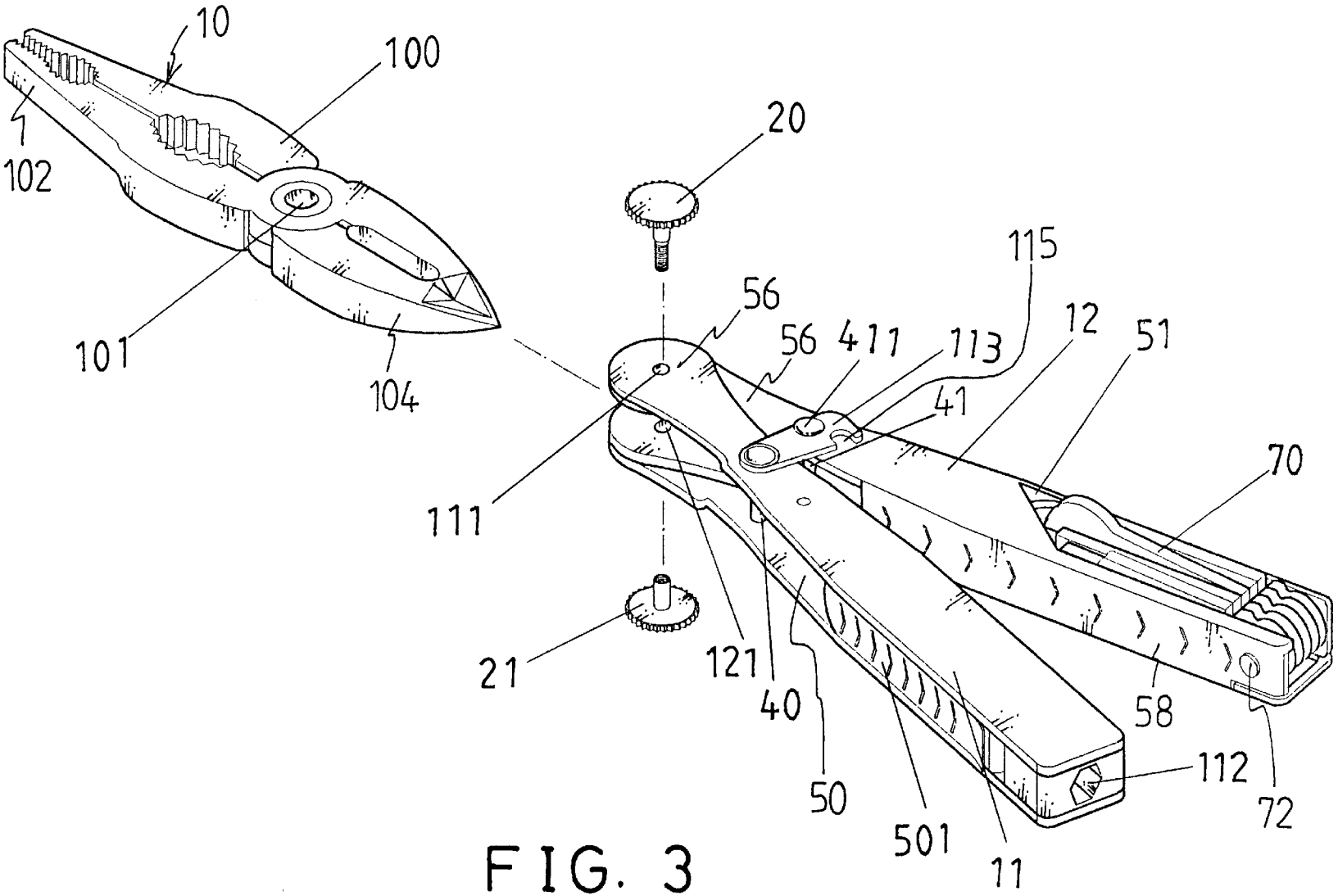
Figure 6:
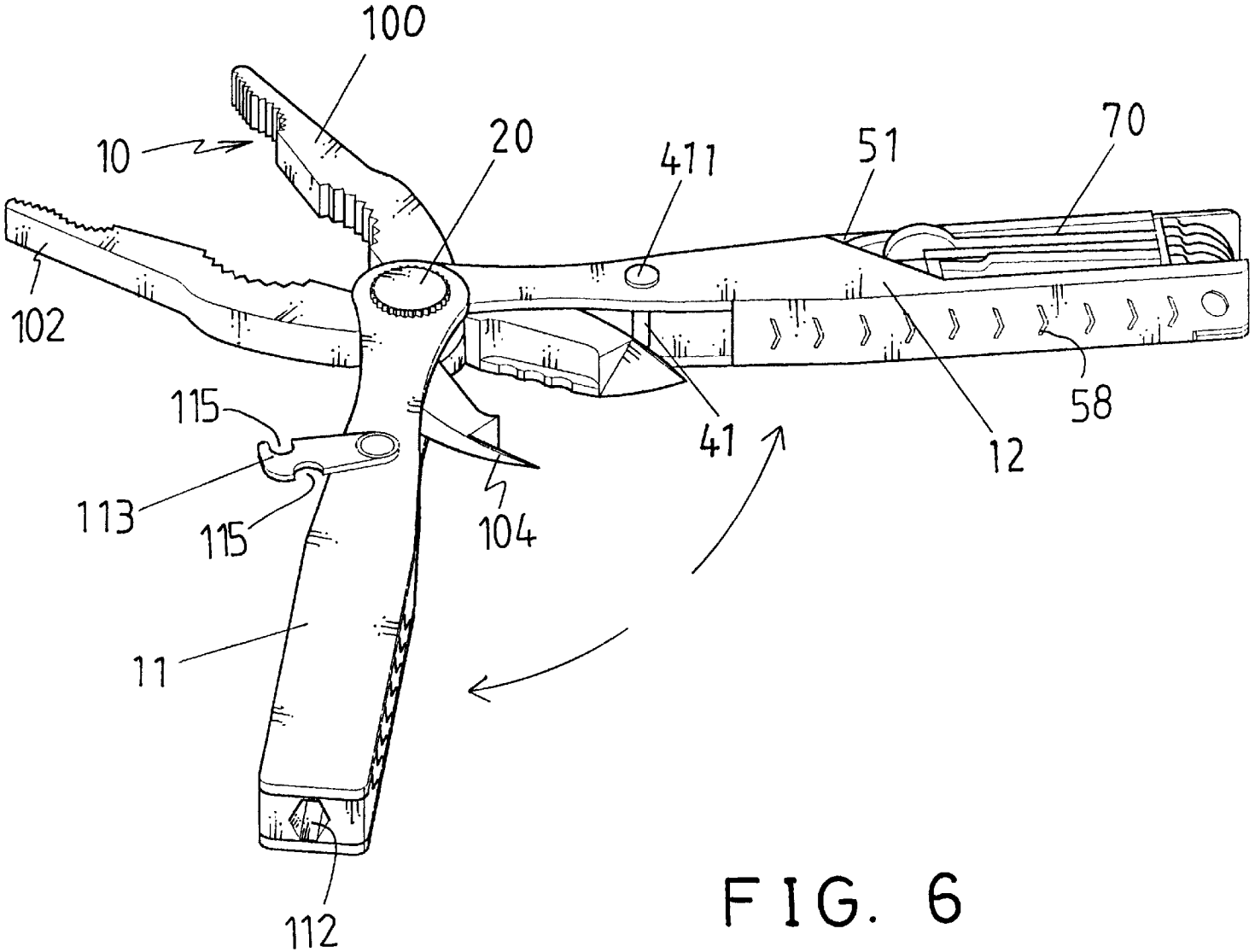
FIGS. 6 and 7 are perspective views illustrating the operation of the tool combination.
Figure 7:
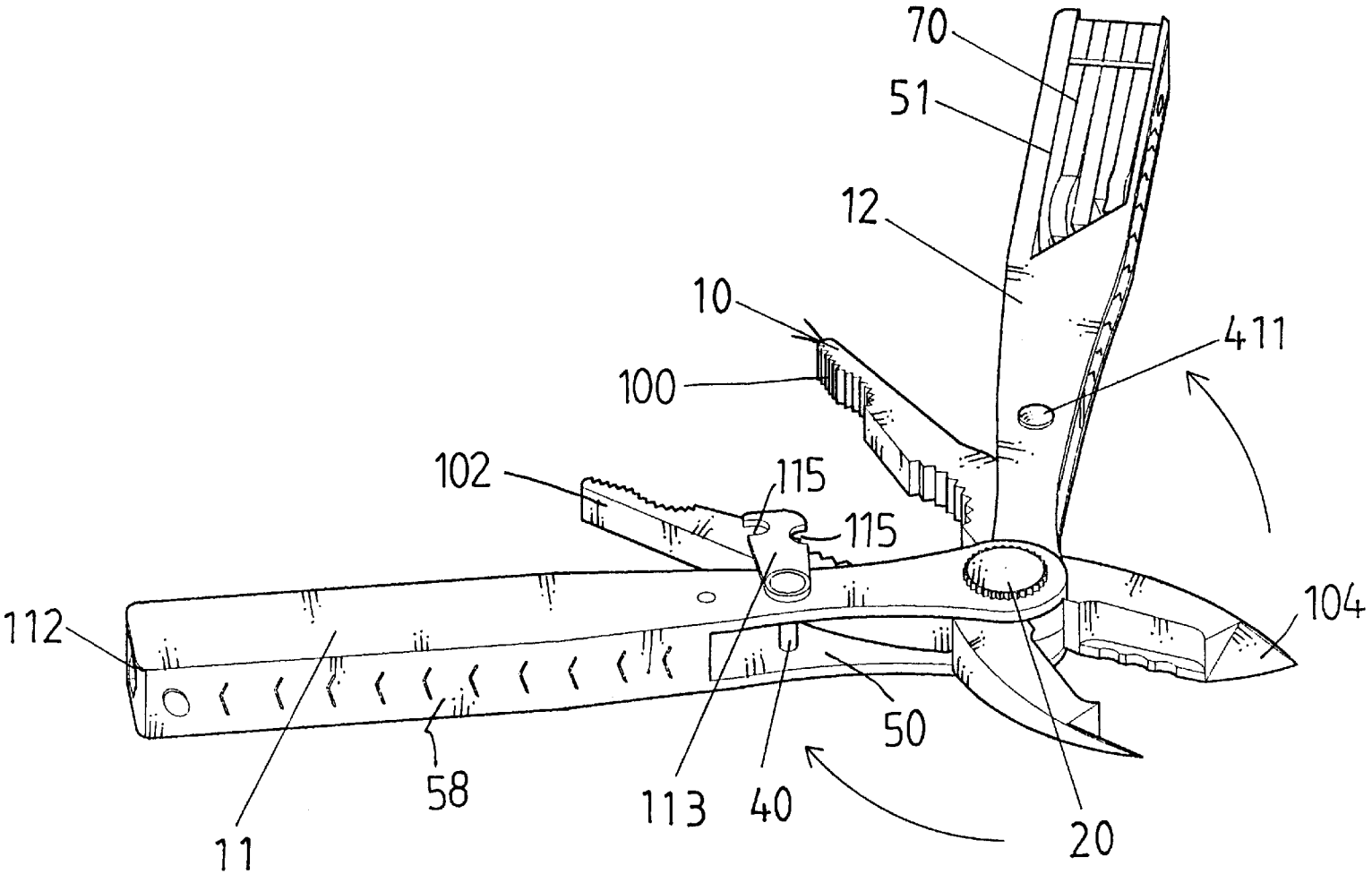

Referring to the drawings, and initially to FIGS. 1–3, a tool combination in accordance with the present invention comprises a pair of handles 11, 12 each including a chamber 50, 51 defined between a pair of panels 56 that are parallel to each other and that include a portion secured together by a wall 58. The handles 11, 12 each includes a pin 40, 41 secured in the middle portion (FIGS. 6, 7) and secured between the panels 56 and extended through the chambers 50, 51 respectively. The handles 11, 12 each includes an aperture 111, 121 formed in one end thereof for receiving a fastener 20, 21 and for allowing the handles 11, 12 to be pivotally coupled together at the fastener 20, 21 and for allowing the handles 20, 21 to be rotated about the fastener 20, 21 (FIGS. 6, 7). The fastener 20, 21 preferably includes a male member or a bolt 20 engaged with a female member or a nut 21.

Figure 5:
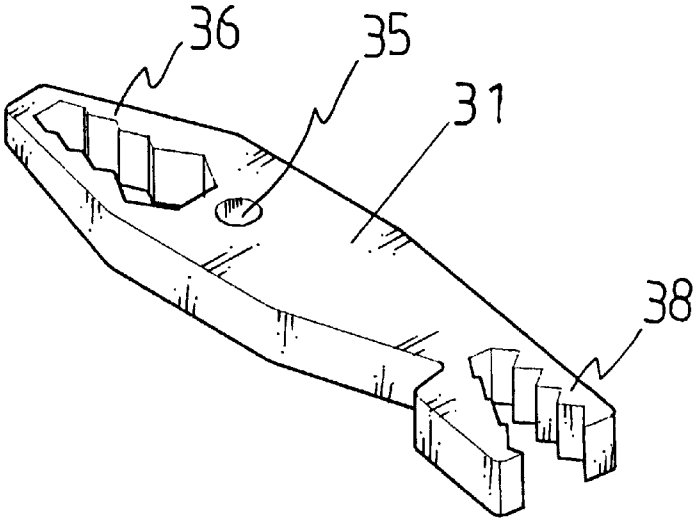
FIGS. 4 and 5 are perspective views illustrating two applications of the tool members.
Figure 4:
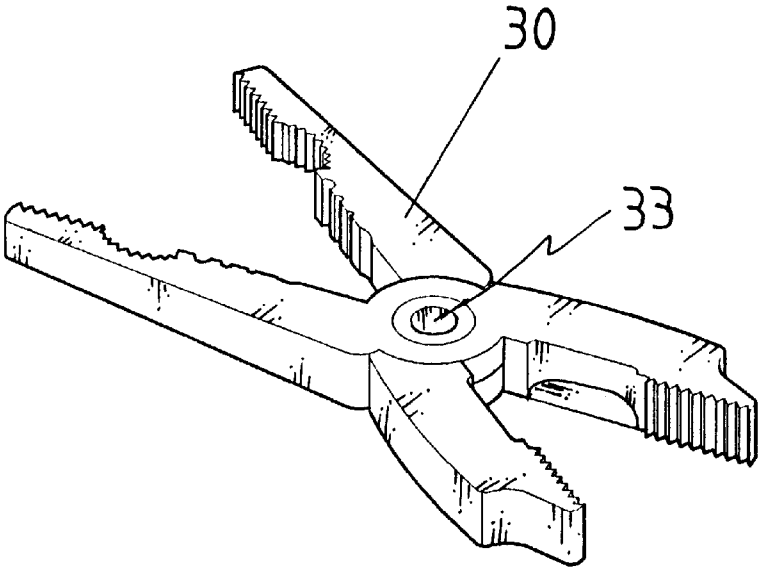

One or more tool members 10, 30, 31 each includes an orifice 101, 33, 35 formed in the middle portion thereof (FIGS. 3–5) for receiving the fastener 20, 21 and for allowing the tool members 10, 30, 31 to be rotatably secured to the handles 11, 12 at the fastener 20, 21. The tool members 10, 30 each includes a pair of beams 100 having the orifice 101, 33, 35 formed in middle portions for receiving the fastener 20, 21 and for allowing the beams 100 to be pivotally coupled together at the fastener 20, 21. The tool members 10, 30 each includes a tool portion 102, such as a plier portion, formed in one end, and each includes another tool portion 104, such as a cutter portion or a wire stripper portion, formed in the other end. The tool member 31 includes a tool portion 36, such as a wrench tool, formed in one end, and includes another wrench tool 38, such as an open wrench, formed in the other end.

It is to be noted that the distances between the fastener 20, 21 and the pins 40, 41 are shorter than the lengths of the tool portions 101, 104 and 36, 38 of the tool members 10, 30, 31, such that the pins 40, 41 may engage with the tool portions 104 of the beams 100 for forcing the tool portions 102 of the beams 100 toward each other, by the handles 11, 12, in order to conduct the plier operations (FIGS. 1, 2, 6). As shown in FIG. 7, when the handles 11, 12 are rotated about the fastener 20, 21 until the pins 40, 41 are engaged with the tool portions 102 of the beams 100, the tool portions 104 of the beams 100 may be forced toward each other by the handles 11, 12 in order to conduct the cutting or wire stripping operations. Either of the tool portions 36, 38 of the tool member 31 may be clamped in place by the pins 40, 41 of the handles 11, 12 such that the tool portions 36, 38 may be operated as a wrench tool. The tool members 10, 30, 31 may be easily changed or replaced with another one by the fastener 20, 21.

A cover 501 is pivotally coupled to the handle 11 at an axle 59 for enclosing a portion of the chamber 50 and for receiving and retaining a number of tool members or tool bits 60 in the chamber 50. The handle 11 includes an engaging hole 112 formed in the end distal to the fastener 20, 21 for receiving the tool bits 60 and for forming a screw driver tool. The handle 12 includes a number of screw driver tool bits or wrench tools or knifes or other tool members 70 pivotally secured to the end of the handle 12 at a shaft 72 distal to the fastener 20, 21 and receivable in the chamber 51. The pin 41 includes one or two ends each having a head 411 formed thereon and extended outward of the handle 12. The other handle 11 includes a latch 113 having one or more latch openings 115 formed therein for engaging with the heads 411 of the pin 41 and for locking the handles 11, 12 together (FIGS. 1–3).

Accordingly, the tool combination in accordance with the present invention includes a number of tool members that may be easily changed and driven by a pair of handles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool combination comprising:

a pair of handles each including a chamber defined by a pair of panels and each including a middle portion having a pin secured therein and each including a first end and a second end, a tool member including a middle portion and including a first end having a first tool portion and a second end having a second tool portion provided therein, and a fastener engaged with said first ends of said handles and said middle portion of said tool member together for allowing said handles and said tool member to be rotated about said fastener, a distance between said fastener and said pins being shorter than said first tool portion and said second tool portion for allowing said pins to engage with said first tool portion when said second tool portion is to be used and for allowing said pins to engage with said second tool portion when said first tool portion is to be used.

2. The tool combination according to claim 1, wherein said tool member includes a pair of beams having a middle portion pivotally secured to said fastener, said beams include a first end having said first tool portion formed thereon and include a second end having said second tool portion formed thereon.

3. The tool combination according to claim 1, wherein said first tool portion and said second tool portion are wrench tools.

4. The tool combination according to claim 1, wherein said second end of a first of said handles includes an engaging hole formed therein for receiving a tool bit.

5. The tool combination according to claim 1, wherein a first of said handles includes a cover pivotally secured thereto for enclosing said chamber of said first handle and for receiving tool bits in said chamber of said first handle.

6. The tool combination according to claim 1, wherein a second of said handles includes a plurality of tools pivotally secured to said second handle at a shaft for allowing said tools to be rotated inward and outward of said chamber of said second handle.

7. The tool combination according to claim 1 further comprising means for locking said handles together.

8. The tool combination according to claim 7, wherein a first of said pins includes a head formed thereon, said locking means includes a latch pivotally secured to a second of said pins, said latch includes at least one latch opening formed therein for receiving said head of said first pin and for locking said handles together.

* * * * *